United States Patent [19]

Scheerhorn

[11] Patent Number: 4,471,638

[45] Date of Patent: Sep. 18, 1984

[54] FRONT REMOVABLE LOCK

[75] Inventor: Douglas Scheerhorn, Grand Rapids, Mich.

[73] Assignee: Steelcase Inc., Grand Rapids, Mich.

[21] Appl. No.: 362,453

[22] Filed: Mar. 26, 1982

[51] Int. Cl.[3] ..... E05B 29/04

[52] U.S. Cl. ..... 70/368

[58] Field of Search ..... 70/368, 367, 369, 370, 70/371, 373, 375

[56] References Cited

U.S. PATENT DOCUMENTS

| | | | |
|---|---|---|---|
| 1,922,889 | 8/1933 | Falk | 70/368 |
| 2,019,534 | 11/1935 | Henst | 70/368 |
| 4,092,056 | 5/1978 | Signore et al. . | |
| 4,202,587 | 5/1980 | Wieland . | |

OTHER PUBLICATIONS

"Locks," by National Lock Hardware, Rockford, Ill., Masterkeyed Security, by Best.

"Your Single Source for a Wide Range of Locking Devices," by Corbin Cabinet Lock, Berlin, Conn.

"Chicago Flex-Ace Locks," by Chicago Lock Co.

"Systematic Customer Design," by Engineered Security Products, Leominster, Mass.

*Primary Examiner*—Robert L. Wolfe

*Attorney, Agent, or Firm*—Price, Heneveld, Huizenga & Cooper

[57] ABSTRACT

A front removable lock for office furniture units, and the like, comprises a housing having an rear plug rotatably mounted in a rear portion of the housing. A front plug, having key operated tumblers, is telescopingly received within a front portion of the housing, and includes a latch mechanism which detachably connects the same with the rear plug. A release is mounted on the rear plug to uncouple the front and rear plugs, and is accessible through a window in the housing when the plugs are rotated into a partially unlocked position. A gate is mounted on the rear plug adjacent to the release, and is positioned such that the gate closes the window when the plugs are rotated into a locked position to prevent unauthorized access to the lock.

29 Claims, 16 Drawing Figures

XII
IX

FRONT REMOVABLE LOCK

CROSS-REFERENCE TO RELATED APPLICATIONS

The present application is related to my copending U.S. patent applications Ser. No. 362,454, filed Mar. 26, 1983, now U.S. Pat. No. 4,457,569, entitled LOCK ARRANGEMENT FOR OFFICE FURNITURE UNITS; and Ser. No. 362,452, filed Mar. 26, 1983 now U.S. Pat. No. 4,445,729, entitled OVER-CENTERED LOCK ARRANGEMENT FOR OFFICE FURNITURE UNITS, which are hereby incorporated by reference.

BACKGROUND OF THE INVENTION

The present invention relates to office furniture units, and in particular to a front removable lock therefore.

Lock arrangements for office furniture units, such as desks, credenzas, file cabinets, storage cabinets, and the like, are generally well known in the art. Front removable locks, such as those disclosed in publications by Chicago Lock Co., National Lock Hardware, Engineered Security Products, and Best, as noted in the Disclosure Statement, include a mechanism to remove and replace the tumbler assembly when required for repair, or to rekey the lock.

Heretofore, front removable locks have required a special key or a special tool to remove the tumbler assembly, which can be somewhat inconvenient to use. Such locks have a rather complex construction which is expensive to manufacture, and typically difficult to maintain and/or repair. Prior front removable locks have required a rather wide housing, such that the mating clearance hole in the front of the furniture unit must be rather large, in the nature of ¾ of an inch or greater. As a result, such locks are not particularly adapted for use in conjunction with compact, in-top lock arrangements, wherein the lock is concealed within the interior of the top of the furniture unit.

SUMMARY OF THE INVENTION

One aspect of the present invention is a front removable lock for office furniture units and the like, comprising a housing adapted for mounting in the furniture unit, and including a sidewall with an aperture therethrough positioned at a preselected location to define a window through which the lock is selectively accessed by a tool. A rear plug is rotatably mounted in a rearward portion of the housing, and includes means for axially positioning the rear plug in the housing. A front plug is telescopingly received in a forward portion of the housing, and is shaped for rotation therein between locked and unlocked positions. The front plug carries means such as tumblers, or the like for rotatably innerlocking the front plug and the housing in the locked position. A mechanism detachably interconnects the front and rear plugs, and includes a release to uncouple the plugs, and permit selective withdrawal of the front plug from the housing. The release is mounted on one of the plugs for rotation therewith, and is positioned to rotate into alignment with the housing aperture in a preselected, unlocked position, whereby insertion of the tool through the window and into engagement with the release uncouples the front and rear plugs. An imperforate gate is positioned adjacent to the release, and closes the window when the plugs are rotated to the locked position, thereby preventing tampering, surreptitious entry, or other unauthorized access to the lock.

The principal objects of the present invention are to provide a front removable lock, having an uncomplicated construction which is less expensive to manufacture, and does not require any special keys or tools. The lock has a very compact design that is particularly adapted for in-top installations. A window in the lock housing provides ready access to the lock release, and is closed when the lock is rotated to the locked position to provide excellent security. The release mechanism can be easily manipulated by any type of slender bar or rod, including a bent paperclip, such that even unskilled personnel can easily remove and replace the front plug portion of the lock when required for repair and/or rekeying. A unique alignment mechanism assures that the front plug is inserted into the housing in the proper orientation. The lock is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

For purposes of description herein, the terms "upper," "lower," "right," "left," "rear," "front," "vertical," "horizontal" and derivatives thereof, shall relate to the invention as oriented in FIGS. 2–6. However, it is to be understood that the invention may assume various alternative orientations, except where expressly specified to the contrary.

Figure 1:
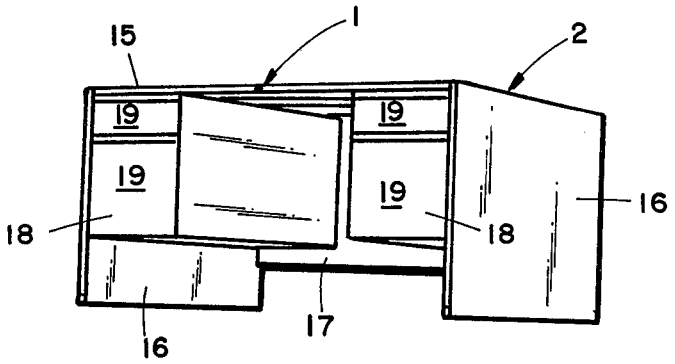
FIG. 1 is a perspective view of an office furniture unit having a front removable lock embodying the present invention installed therein.

The reference numeral 1 (FIGS. 1 and 2) generally designates a front removable lock embodying the present invention, shown installed in an office furniture unit 2. Front removable lock 1 comprises a barrel or housing 3 (FIG. 7), with a rear plug 4 rotatably mounted therein. A front plug 5, having key operated tumblers 6, is telescopingly received within a front portion of housing 3, and includes a latch mechanism 7 which detachably connects the same with rear plug 4. A releasable catch 8 is mounted on rear plug 4 to uncouple the front and rear plugs 4 and 5, and is accessible through a window 9 (FIGS. 3 and 5) in housing 3 when plugs 4 and 5 are rotated toward the unlocked position. When plugs 4 and 5 are rotated to the locked position, a gate 10 closes window 9 to prevent unauthorized access to the lock.

Front removable lock 1 may be used in a wide variety of different types of office furniture units, including desks, credenzas, file cabinets, storage cabinets, and the like. The compact construction of lock 1 makes it particularly adapted for use in conjunction with in-top installations, such as the desk shown in FIGS. 1–6.

In the illustrated example, desk 2 (FIGS. 1 and 2) includes an elongate top 15, which extends the length of the unit, and is supported by a pair of end panels 16. A rear panel 17 interconnects end panels 16, and a pair of pedestals 18 are suspended from the lower side of top 15 on the left and right-hand sides thereof, and include compartment lock mechanisms (not shown) operably connected with lock 1 to lock and unlock compartments 19.

Desk top 15 is described in detail in my copending United States patent applications entitled LOCK ARRANGEMENT FOR OFFICE FURNITURE UNITS and OVER-CENTERED LOCK ARRANGEMENT FOR OFFICE FURNITURE UNITS, which are referenced hereinabove, and comprises a formed, rigid shell 23 (FIGS. 3–6) which is bent rearwardly along one edge to define the forward edge 24 of top 15. A cover layer 25 overlies shell 23, and is attached thereto by means such as adhesive or the like, to provide an aesthetically pleasing appearance, as well as a writing surface. A U-shaped reinforcing channel 26 is mounted within top 15 along the forward edge thereof, and comprises a base 27, upstanding sidewalls 28, and end flanges 29, which are oriented rearwardly, and fixedly attached to the lower surface of shell 23. Lock 1 is inserted through mating, aligned apertures in channel sidewalls 28, and the forward edge 24 of top 15, and is detachably mounted therein by fasteners 30. A removable cover 31 encloses the lower, rearward portion of top 15. A trim strip 32 is attached to channel base 27 by fasteners 33, and extends over the free edge of cover 25.

Trim strip 32 and channel base 27 have centrally located, aligned apertures 38 and 39 respectively therethrough, which are disposed directly below the window 9 in lock housing 3, and permit insertion of a tool or pointed instrument 40 therethrough to engage releasable catch 8, as described in greater detail hereinafter.

Housing 3 is a generally cylindrically-shaped structure, having a flange 44 at the rearward end thereof, through which fasteners 30 extend to mount lock 1 within desk top 15. A rim 45 is positioned adjacent the forward end of housing 3, and centers housing 3 within channel 26. A slot 46 extends through the sidewall 47 of housing 3, and is adapted to receive a crescent-shaped key 48 therein for rotatably mounting rear plug 4, as described below.

Window 9 also extends through housing sidewall 47, and has a generally rectangular plan shape. When lock 1 is installed in furniture unit 2, window 9 is oriented in a generally downwardly direction to align with the apertures 38 and 39 in the lower surface of top 15. The lower edge 49 of window 9 is inclined downwardly, along a substantially vertical plane, to facilitate insertion of tool 40.

The longitudinally interconnecting locking action of latch 7 and releasable catch 8, as described below, has a very low profile, such that the width or outside diameter of housing 3 can be reduced substantially. In the illustrated example, the clearance aperture required for lock 1 is in the nature of 17/32 inches, as compared to prior front removable locks, which require ¾ inch and more. Hence, lock 1 is particularly adapted for in-top applications, as illustrated herein.

Figure 13:
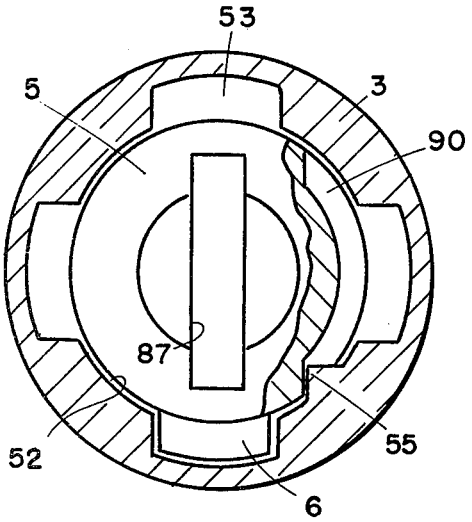
FIG. 13 is a cross-sectional view of the lock, taken along the line XIII—XIII of FIG. 5, and being shown in the locked position.
Figure 14:
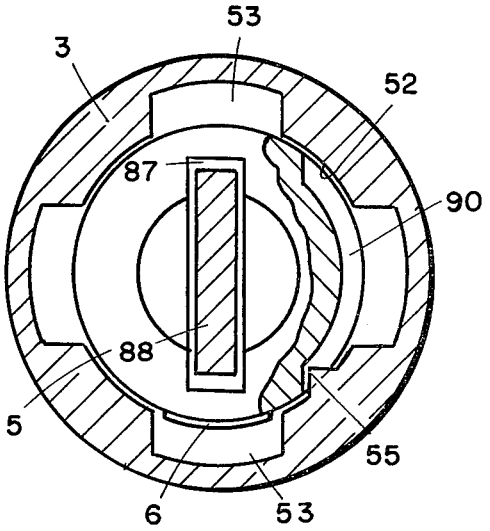
FIG. 14 is a cross-sectional view of the lock shown in FIG. 13, with a key inserted therein to retract the lock tumblers.
Figure 15:
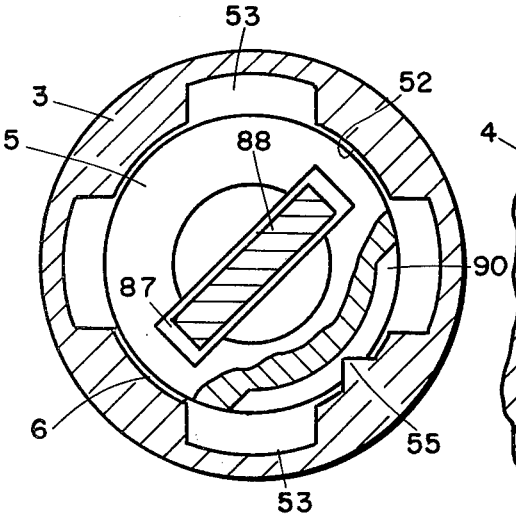
FIG. 15 is a cross-sectional view of the lock shown in FIGS. 13 and 14, with the front plug rotated to a partially unlocked position to remove the front plug.

The interior of housing 3 (FIG. 7) includes four ribs or splines 52 which project radially inwardly from the interior surface of housing 3, extend longitudinally therealong, and are spaced 90° apart. Splines 52 define arcuate grooves 53 therebetween in which the tumblers 6 of front plug 5 are received rotatably to lock the assembly. A cylindrical collar 54 is positioned at the forward end of housing 3, and includes a radially inwardly projecting tab or key 55 (FIGS. 13–15). The rearward end of housing 3 has a cylindrical sleeve bearing 56.

Rear plug 4 (FIG. 7) is a generally cylindrically-shaped structure, sized for telescoping reception within housing 3, and includes a rearwardly extending shaft 59 with generally square end 60 to attach a link arrangement (not shown) thereto for manipulating the compartment lock mechanism. A cylindrically-shaped journal portion 61 of rear plug 4 is closely received within the mating bearing sleeve 56 of housing 3 to align rear plug 4 in a coaxial relationship within housing 3. The medial portion of rear plug 4 includes a circumferential groove 62, in which key 48 is received to positively, axially position rear plug 4 within housing 3. The forward end 64 of rear plug 4 includes a slot 65 therethrough, which opens to the exterior surface 66 of forward end 64 along one side thereof, and is closed at the opposite side. Slot 65 has a generally rectangular transverse cross-sectional shape, with an enlarged forward end or socket 67. A pair of ribs 68 are positioned along the open side of slot 65 for purposes to be described in greater detail hereinafter. The closed surface 66 of the forward end 64 of rear plug 4 defines gate 10, and includes a radially extending slot 69 in which releasable catch 8 is slidably received. Latch slot 69 has a rectangular transverse cross-sectional shape, and closely receives mating releasable catch 7 therein for reciprocal movement in a plane disposed generally perpendicular to the axis of rotation of plugs 4 and 5.

Figures 7, 8, 9, 10, 11:
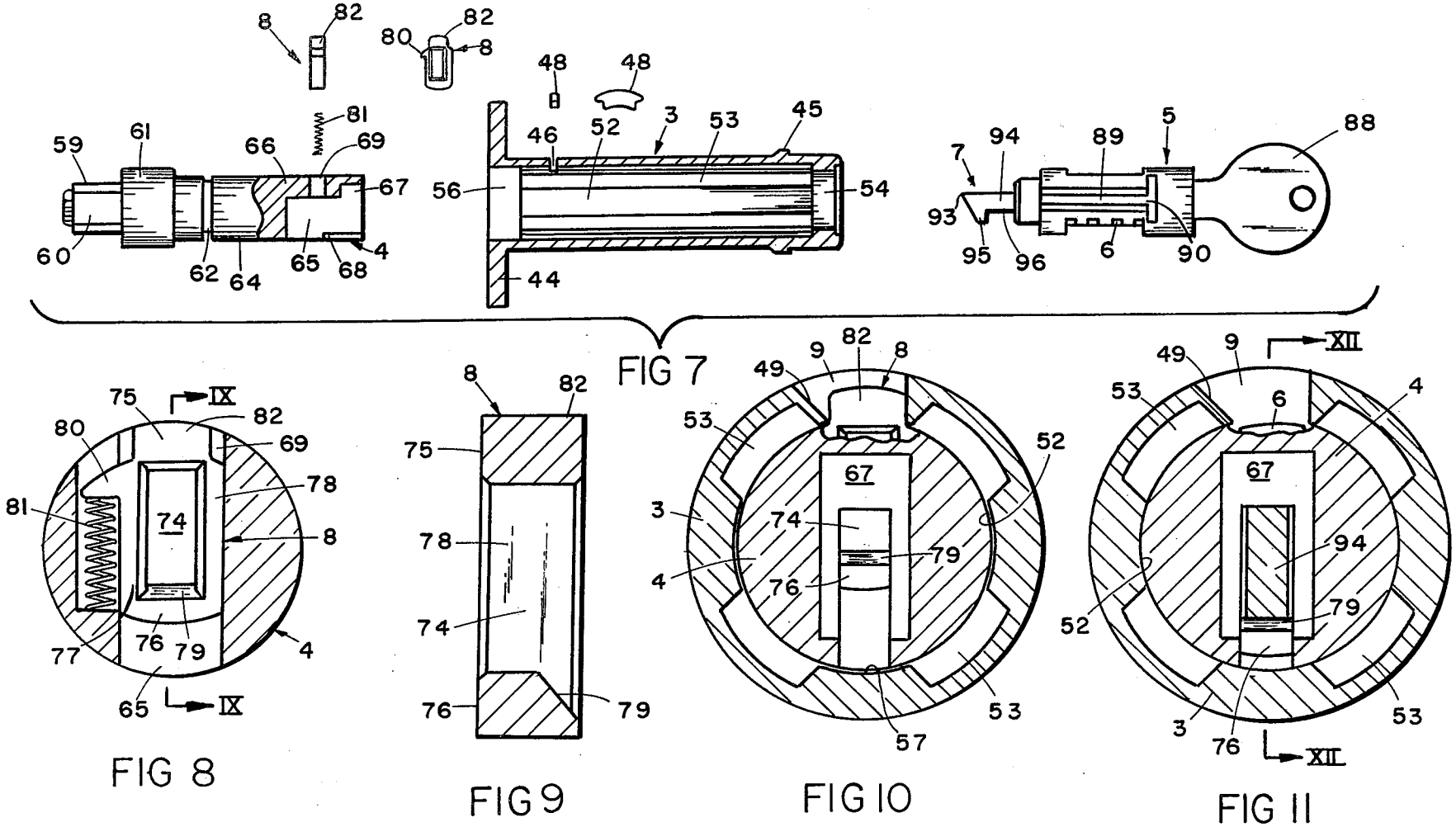
FIG. 7 is an exploded, side elevational view of the lock, with portions thereof broken away to reveal internal construction.
FIG. 8 is a cross-sectional view of the lock, taken along the line VIII—VIII of FIG. 3.
FIG. 9 is an enlarged, cross-sectional view of a catch portion of the lock, taken along the line IX—IX of FIG. 8.
FIG. 10 is a vertical cross-sectional view of the lock, taken along the line X—X of FIG. 5, with the front plug removed.
FIG. 11 is a vertical cross-sectional view of the lock, as shown in FIG. 10, but with the front plug assembled.

As best illustrated in FIGS. 8 and 9, catch 8 includes a central aperture 74 therethrough, defined by a generally rectangular plate or frame, having end segments 75 and 76, and side segments 77 and 78. The forward or leading edge 79 of inward frame end 76 is tapered downwardly to facilitate latching. The remaining edges of aperture 74 are also beveled to insure smooth coupling action. The lefthand side segment 77 (as viewed in FIG. 8) includes a laterally extending arm 80, which engages a spring 81 to resiliently bias catch 8 in a radially outwardly direction. A bolt or plunger 82 protrudes from the outer end segment 76, and has a generally rectangular transverse cross-sectional shape which is sized to be received within window 9 for purposes to be described in greater detail hereinafter.

With reference to FIG. 7, tumblers 6 are mounted in front plug 5, and comprise spring loaded, disc-type tumblers which reciprocate transverse to the axis of rotation of front plug 5. Tumblers 6 are normally biased radially outwardly into the grooves 53 defined between housing splines 52, as shown in FIG. 13, to rotatably lock front plug 4 in housing 3. The forward end of front plug 5 is generally cylindrical in shape for pivotal reception within the collar 54 of housing 3, and includes an end slot 87 (FIGS. 13–15) in which a key 88 is received. Insertion of key 88 retracts tumblers 6 into the body of front plug 5, as shown in FIG. 14, to permit rotation of front plug 5 with respect to housing 3. A keyway 89 extends longitudinally along one side of front plug 5, and mates with key 55 to insure that front plug 5 is properly aligned with rear plug 4 when the latter is inserted into housing 3. A circumferentially extending slot 90 is disposed at the forward end of keyway 89, and permits front plug 5 to rotate 90° between the locked and unlocked positions. Key 55 abuts the ends of slots 90 to form positive stops at the locked and unlocked positions.

A hook-shaped latch arm 93 projects rearwardly from the rear end of front plug 5, and includes a generally rectangular shank 94 and a wedge-shaped stop or barb 95 at the free end thereof. Latch arm 93 also includes an enlarged key or plug 96, which has a rectangular transverse cross-sectional shape, and is closely received within the mating socket 67 of rear plug 4 to positively transmit rotation therebetween when the front and rear plugs are coupled.

Rear plug 4 is mounted in housing 3 by depressing catch 8, aligning rear plug 4 with housing 3, so that the plunger portion 82 of catch 8 is in line with window 9, and inserting rear plug 4 into the rearward end of housing 3 until groove 62 is aligned with key slot 46. Spring 81 will extend catch plunger 82 through window 9 when rear plug 4 is in its proper position. Contact between the upper segment 75 of catch 8 and the housing edges forming window 9 limits extension of catch plunger 82. Window 9 is preferably positioned through one of the splines 52 on the interior of housing 3, so that abutment between the spline and the catch plunger 82 retains catch 8 in a retracted position during insertion of rear plug 4 into housing 3. Crescent-shaped key 48 is inserted into mating housing slot 46, such that the free edge of key 48 rides in groove 62. Key 48 is then fixedly anchored in housing 3 by means such as staking or the like.

Figure 12A:
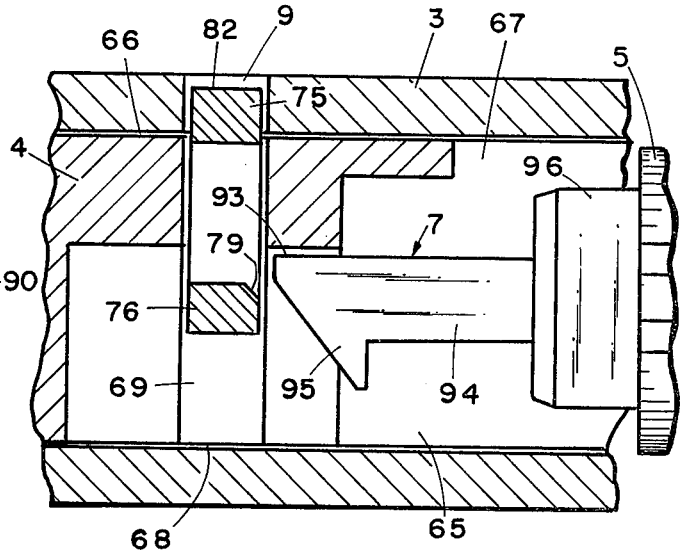
FIG. 12A is a fragmentary, cross-sectional view of the lock as shown in FIG. 12, but with the front plug uncoupled.
Figure 12:
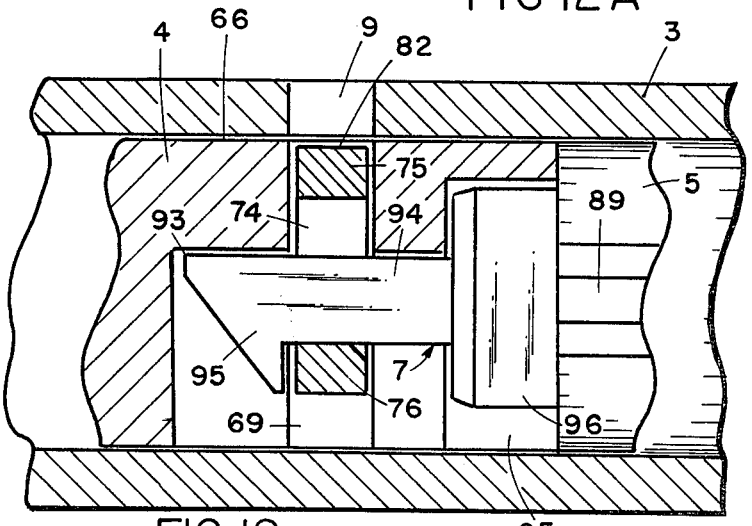
FIG. 12 is a fragmentary, cross-sectional view of the lock, taken along the line XII—XII of FIG. 11.

Front plug 5 is inserted into housing 3 in the following manner. Key 88 is first inserted into the end slot 87 in front plug 5 to retract tumblers 6. Front plug 5 is then oriented so that keyway 89 is aligned with housing key 55. In the illustrated example, keyway 89 is aligned with key 55 when tumbler key 88 is inclined to the left at a 45° angle, as viewed from the front of the lock. Front plug 5 is then inserted into housing 3, intil the leading edge of barb 95 abuts the inclined edge 79 of the inward segment 76 of catch 7. As rearward translation of front plug 5 continues, abutment between barb 95 and catch edge 79 retracts catch 7 inwardly against the force of spring 81, until barb 95 passes over the rearward face of catch segment 76, at which time spring 81 extends catch 7 radially outwardly, thereby capturing latch arm 93 therein, as shown in FIG. 12. The coupling of latch arm 93 in catch 7 prevents longitudinal or axial separation of front and rear plugs 5 and 4. The reception of the key portion 96 of front plug 5 into the mating socket 67 of rear plug 4 rotatably interconnects the front and rear plugs. When rear and front plugs 4 and 5 are so coupled, the upper surface of plunger 82 is disposed slightly below the exterior surface 66 of rear plug 4, as shown in FIG. 11, to permit plugs 4 and 5 to pivot together 90° within housing 3.

Figure 5:
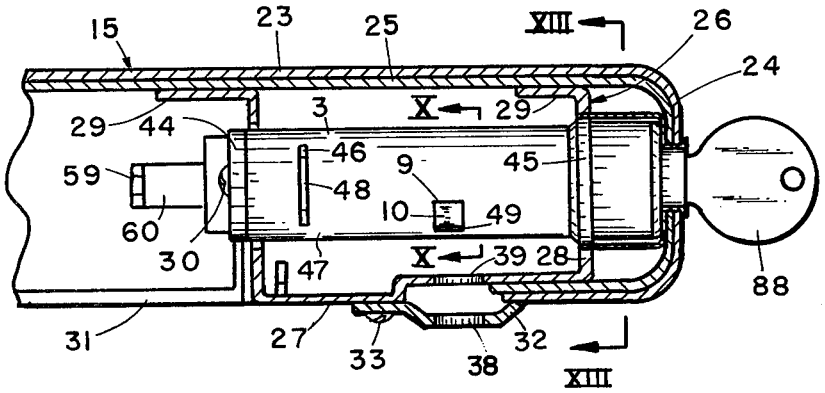
FIG. 5 is a fragmentary, vertical cross-sectional view through the top of the furniture unit, with the lock shown in a fully locked position.
Figure 6:
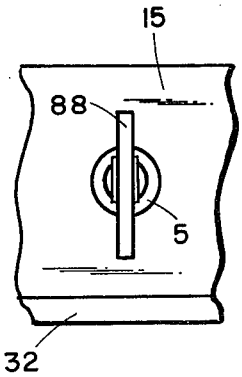
FIG. 6 is a fragmentary, front elevational view of the furniture unit and lock, with the lock shown in the fully locked position illustrated in FIG. 5.

When key 88 is rotated to the vertical, locked position shown in FIGS. 5 and 6, the imperforate portion of the exterior surface 66 of rear plug 4, which defines gate 10, closes window 9 to prevent unauthorized access to the lock. When key 88 is withdrawn from lock 1, plugs 4 and 5 cannot be rotated.

To remove front plug 5 for repair or rekeying, the user first inserts key 88 into front plug 5, and rotates plugs 4 and 5 to a preselected, unlocked position so that plunger 82 is aligned with window 9. Preferably, the removal position for front plug 5 is selected so that when plunger 82 is aligned with window 9, tumblers 6 are aligned with an adjacent housing spline 52. In this configuration, engagement between tumblers 6 and housing spline 52 prevents the withdrawal of key 88 from front plug 5. Hence, the enlarged, rounded end of key 88 can be easily grasped to facilitate withdrawing front plug 5 from housing 3 after the front and rear plugs 4 and 5 have been uncoupled.

Figure 2:
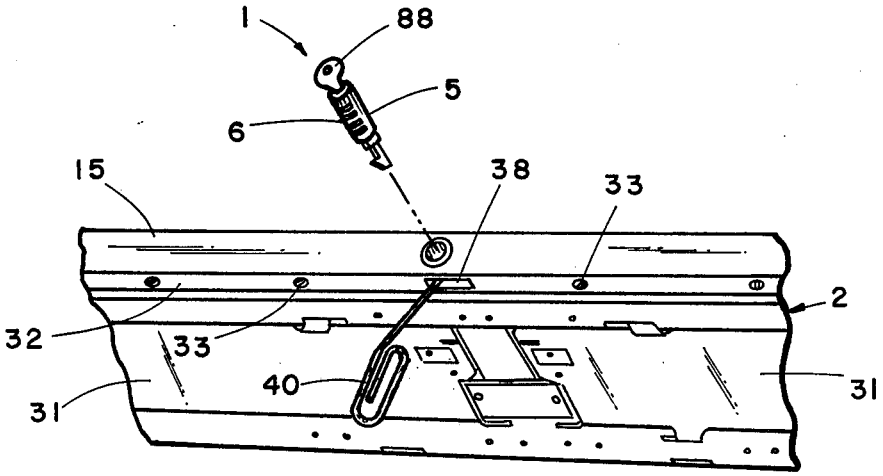
FIG. 2 is a fragmentary, perspective view of the furniture unit and lock, with a front plug portion of the lock shown in a disassembled condition.
Figure 3:
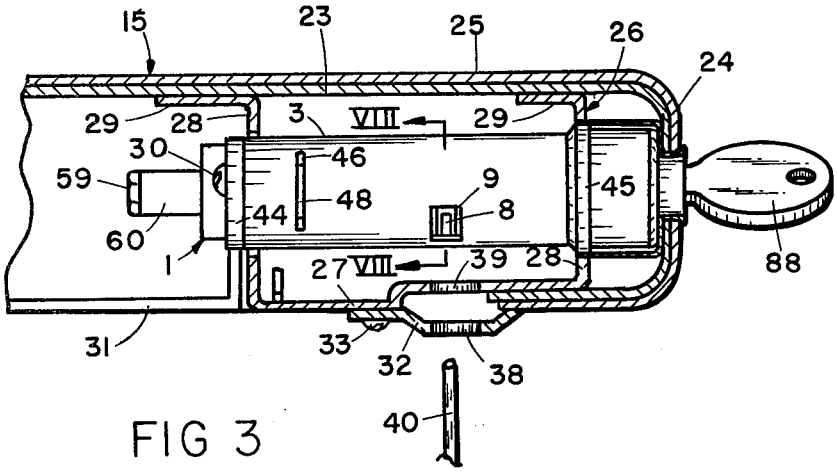
FIG. 3 is a fragmentary, vertical cross-sectional view through the top of the furniture unit, showing the lock in a partially unlocked position to release the front plug.
Figure 4:
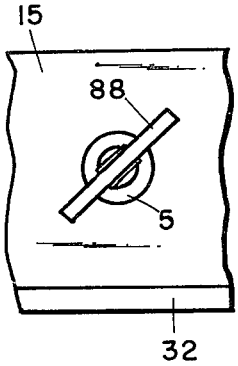
FIG. 4 is a fragmentary, front elevational view of the furniture unit and lock, shown in the partially unlocked position illustrated in FIG. 3.

The user then inserts any type of reasonably slender, rigid bar or rod 40 through the apertures 38 and 39 in the bottom of top 15, and into window 9, as illustrated in FIG. 2. It is to be understood that rod 40 is not any special type of tool, and may comprise any handy or convenient instrument, such as the bent paperclip illustrated in FIG. 2. Hence, the inconvenience of locating special keys or tools to rekey the lock is eliminated. The user pushes the end of instrument 40 into abutment with the exterior surface of plunger 82, and forces the plunger inwardly against the force of spring 81, so that catch 8 disengages the barbed end 95 of latch arm 93. With plunger 82 depressed, the user simply grasps the rounded end of key 88, and pulls front plug 5 forwardly out from housing 3. Instrument 40 is then withdrawn from window 9, and spring 81 automatically extends plunger 82 through window 9, thereby positively positioning rear plug 4 in its proper orientation to receive the latch 93 of replacement front plug 5, as shown in FIG. 12A. Hence, when the replacement front plug 5 is inserted into housing 3, latch 93 will align with the mating slot 65 in rear plug 4.

Front removable lock 1 has a very uncomplicated construction, which is less expensive to manufacture, and enables even unskilled personnel to easily remove and replace the front plug 5 without any special tools. The release plunger and mating window concept not only facilitates quick and easy removal of front plug 5, but also maintains excellent security to prevent tampering or surreptitious entry by unauthorized personnel. Further, proper alignment is always maintained between the rear and front plugs 4 and 5. The compact configuration of lock arrangement 1 particularly adapts the same for in-top installations.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A front removable lock for office furniture units and the like, comprising:

a housing adapted for mouting in an office furniture unit, and including a sidewall with an aperture therethrough positioned at a preselected location to define a window through which said lock is selectively accessed by a tool;

a rear plug rotatably mounted in a rearward portion of said housing, and including means for axially positioning said rear plug in said housing;

a front plug telescopingly received in a forward portion of said housing, and shaped for rotation therein between locked and unlocked positions; said front plug carrying means thereon for rotatably interlocking said front plug and said housing in the locked position;

means for detachably interconnecting said front and rear plugs, whereby said plugs rotate together when coupled;

means for releasing said plug interconnecting means to uncouple said plugs and permit selective withdrawal of said front plug from said housing; said releasing means being mounted on said rear plug, and rotating therewith in said housing; said releasing means being positioned on said rear plug to rotate into alignment with said housing aperture in a preselected, unlocked position, which is spaced from said locked position, whereby insertion of the tool through said window and into engagement with said releasing means uncouples said front and rear plugs to permit removal of said front plug; said rear plug including an imperforate gate positioned thereon, which closes said window in the locked position, thereby preventing unauthorized access to said lock.

2. A lock as set forth in claim 1, including:

means for retaining said rear plug in a preselected angular orientation in said housing when said front plug is uncoupled to facilitate alignment of said front and rear plugs for recoupling.

3. A lock as set forth in claim 2, wherein:

said lock comprises a key lock, having tumblers mounted in said front plug, and a key selectively inserted into a mating end slot in said front plug to manipulate said tumblers, and thereby define said interlocking means.

4. A lock as set forth in claim 3, including:

means for retaining said key in said front plug when said front plug is being removed from said housing to facilitate grasping and withdrawing said front plug.

5. A lock as set forth in claim 4, wherein:

said releasing means includes a catch plunger slidably mounted in said rear plug for reciprocation therein in a direction generally transverse to the axis of rotation of said plugs to couple and uncouple said front and rear plugs.

6. A lock as set forth in claim 5, wherein:

said catch plunger is accessible through said window in said preselected unlocked position, and is manipulated by any relatively slender, rigid rod, such that the tool need not be specially designed for said lock.

7. A lock as set forth in claim 6, wherein:

said housing has a relatively small outside diameter adapted for in-top installations.

8. A lock as set forth in claim 7, wherein said plug interconnecting means comprises:

a latch arm extending from a rearward end of said front plug, and including a barb-shaped free end; and a catch slidably mounted in a forward end of said rear plug for translation in a direction generally transverse to the axis of rotation of said plugs between extended and retracted positions; said catch including a central aperture through which said latch arm is received, with an end edge positioned to engage the free end of said latch arm to interconnect said front and rear plugs.

9. A lock as set forth in claim 8, including:

means for resiliently urging said catch toward the extended position, whereby insertion of said latch arm into the central aperture of said catch automatically interconnects said latch arm and said catch.

10. A lock as set forth in claim 9, wherein:

said latch arm includes a key portion disposed adjacent to said free end, and having a non-circular, transverse cross-sectional shape;

said rear plug forward end includes a socket into which said latch arm key portion is closely received to positively transmit rotational motion of said front plug to said rear plug.

11. A lock as set forth in claim 10, wherein:

said catch plunger is integrally mounted on an exterior end of said catch, and is shaped for close reception in said window when said front plug is uncoupled from said rear plug and removed from said housing to define said rear plug retaining means.

12. A lock as set forth in claim 11, wherein:

said housing includes an interior surface, with a plurality of parallel, circumferentially spaced apart ribs extending therealong, which define channels therebetween in which said tumblers are closely received to define said interlocking means.

13. A lock as set forth in claim 12, wherein:

said tumblers are aligned with one of said ribs in said preselected, unlocked position, whereby engagement between said tumblers and said one rib prevents removal of said key from said front plug during withdrawal of said front plug to define said key retaining means.

14. A lock as set forth in claim 13, wherein:

said front plug includes a linear, longitudinally extending channel along an outer surface thereof; and said housing includes a radially inwardly protruding key which mates with said front plug channel, and is disposed to retain said front plug in a preselected angular orientation within said housing during insertion of said front plug to insure alignment between said latch arm and said catch.

15. A lock as set forth in claim 14, wherein:

said rear plug has a generally cylindrically-shaped portion in which said catch is mounted, with an arcuate outer surface closely underlying said window to define said gate.

16. A lock as set forth in claim 15, wherein:

said housing aperture extends through one of said ribs to facilitate assembly of said rear plug into said housing.

17. A lock as set forth in claim 16, wherein:

said window is oriented in a generally downwardly orientation to access the same from a lower side of said furniture unit.

18. A lock as set forth in claim 17, wherein said rear ug positioning means comprises:

a circumferential groove in said rear plug;

a crescent-shaped key mounted in said housing, and having a free edge projecting into said groove.

19. A lock as set forth in claim 1, wherein:

said lock comprises a key lock, having tumblers mounted in said front plug, and a key selectively inserted into a mating end slot in said front plug to manipulate said tumblers, and thereby define said interlocking means.

20. A lock as set forth in claim 19, including:

means for retaining said key in said front plug when said front plug is being removed from said housing to facilitate grasping and withdrawing said front plug.

21. A lock as set forth in claim 1, wherein:

said releasing means includes a catch plunger slidably mounted in said rear plug for reciprocation therein in a direction generally transverse to the axis of rotation of said plugs to couple and uncouple said front and rear plugs.

22. A lock as set forth in claim 21, wherein:

said catch plunger is accessible through said window in said preselected unlocked position, and is manipulated by any relatively slender, rigid rod, such that the tool need not be specially designed for said lock.

23. A lock as set forth in claim 1, wherein:

said housing has a relatively small outside diameter adapted for in-top installations.

24. A lock as set forth in claim 1, wherein said plug interconnecting means comprises:

a latch arm extending from a rearward end of said front plug, and including a barb-shaped free end; and a catch slidably mounted in a forward end of said rear plug for translation in a direction generally transverse to the axis of rotation of said plugs between extended and retracted positions; said catch including a central aperture through which said latch arm is received, with an end edge positioned to engage the free end of said latch arm to interconnect said front and rear plugs.

25. A lock as set forth in claim 24, including:

means for resiliently urging said catch toward the extended position, whereby insertion of said latch arm into the central aperture of said catch automatically interconnects said latch arm and said catch.

26. A lock as set forth in claim 1, wherein:

said rear plug has a generally cylindrically-shaped portion in which said releasing means is mounted, with an arcuate outer surface closely underlying said window to define said gate.

27. A lock as set forth in claim 1, wherein:

said window is oriented in a generally downwardly orientation to access the same from a lower side of said furniture unit.

28. A lock as set forth in claim 1, wherein said rear plug positioning means comprises:

a circumferential groove in said rear plug;

a crescent-shaped key mounted in said housing, and having a free edge projecting into said groove.

29. A lock as set forth in claim 1, wherein:

said preselected position in which said releasing means aligns with said window comprises a partially unlocked position disposed between said locked and unlocked positions.

* * * * *